US005333743A

United States Patent [19]

Loewke et al.

[11] Patent Number: 5,333,743

[45] Date of Patent: Aug. 2, 1994

[54] CLOTHES HOOK ASSEMBLY

[76] Inventors: Eunice R. Loewke, P.O. Box 344, Kenwood, Calif. 95452; Daniel D. Loewke, 3060 NE. Wheeler St., Poulsbo, Wash. 98370

[21] Appl. No.: 986,079

[22] Filed: Dec. 4, 1992

[51] Int. Cl.[5] ..... A47F 5/00

[52] U.S. Cl. ..... 211/87; 211/32

[58] Field of Search ..... 211/32, 87, 94; 248/304, 307, 225.1

[56] References Cited

U.S. PATENT DOCUMENTS

| | | | |
|---|---|---|---|
| 44,853 | 11/1864 | Colburn | 248/307 |
| 1,786,038 | 12/1930 | Swanson | 248/307 |
| 1,848,937 | 3/1932 | Coventry | 211/87 X |
| 3,733,043 | 5/1973 | Binns et al. | 211/87 X |
| 4,546,888 | 10/1985 | Rosberg et al. | 211/87 |
| 4,658,967 | 4/1987 | Wang | 211/94 |

FOREIGN PATENT DOCUMENTS

| | | | |
|---|---|---|---|
| 2116018 | 9/1983 | United Kingdom | 248/307 |

*Primary Examiner*—Robert W. Gibson, Jr.
*Attorney, Agent, or Firm*—Howard Cohen

[57] ABSTRACT

An improved clothes hook assembly includes a hanger web having a serpentine configuration having multiple peaks and valleys spaced along the length of the web, with short linear segments extending between the adjacent peaks and valleys. The cross-sectional configuration of the web comprises a broad T-shape defined by continuous upper and lower flanges extending from respecting upper and lower edges of the web, the flanges being contiguous with the outer surface of the web. The web is preferably integrally formed and includes a plurality of holes for securing the web to a vertical structural member such as a wall or door. A plurality of hooks are adapted to be removably secured to the web. Each hook includes a medial linear portion, and a lower arm having a U configuration depending from the medial portion. An upper arm projects obliquely upwardly from the medial portion, and both the upper and lower arms terminate distally in ball-shaped ends. The upper and lower arms are disposed in a common hook plane. The rear surface of the medial portion includes a T-shaped slot dimensioned to encompass and engage the T-shaped cross-section of the web, the engagement removably retaining the hook on the web. When the web baseline is disposed in a horizontal orientation, the hooks may be secured at each valley location of the web, so that the planes of the hooks are oriented vertically. If the web is disposed to that the baseline is oblique to horizontal, the hooks may be secured to the linear segments of the web, so that the hooks are supported with the hook planes in a vertical orientation.

8 Claims, 2 Drawing Sheets

CLOTHES HOOK ASSEMBLY

BACKGROUND OF THE INVENTION

The field of this invention includes devices for hanging clothing and other domestic items.

There are known in the prior art various forms of hook assemblies adapted to suspend clothing and similar items for temporary storage. Such devices include single hooks that are secured to a wall or door surface by adhesives or nail or screw fasteners, or suspended from the upper edge of a door (typically a closet door). Other devices include strips adapted for supporting a plurality of hooks, the strips being secured to a door or wall surface by adhesives or penetrating fasteners. These assemblies are advantageous in that they provide increased hanging capacity by increasing the number of hooks available for supporting articles, while minimizing the number of fasteners extending into the supporting wall or door.

In general, hook assemblies provide a fixed number of hooks secured to the strip. Some assemblies provide means for removing or adding hooks to the strip, but these arrangements are generally difficult to use.

Hook assemblies based on a strip secured to the wall or door are generally arranged so that the strip may be used only in a horizontal or a vertical orientation. This limitation is occassioned by the fact that the hooks are assembled to the strip in a fixed angular orientation, and placing the strip in a non-orthogonal orientation causes the hooks to be canted from vertical, reducing their effectiveness.

SUMMARY OF THE PRESENT INVENTION

The present invention generally comprises an improved clothes hook assembly. A salient feature of the invention is that it is adapted to be secured to a vertical structure in a horizontal disposition or in an oblique disposition. The invention also permits the use of a variable number of hooks, and provides an easy means for assembling or removing hooks therefrom.

The invention includes a hanger web extending along a nominal baseline. The web is provided with a serpentine or sinusoidal configuration having multiple peaks and valleys spaced along the length of the web, with short linear segments extending between the adjacent peaks and valleys. The cross-sectional configuration of the web comprises a broad T-shape defined by continuous upper and lower flanges extending from respecting upper and lower edges of the web, the flanges being contiguous with the outer surface of the web. The web is preferably formed integrally of molded polymer plastic or the like, and includes a plurality of holes for securing the web to a vertical structural member such as a wall or door.

The invention also includes a plurality of hooks adapted to be removably secured to the web. Each hook includes a medial linear portion, and a lower arm having a U configuration depending from the medial portion. An upper arm projects obliquely upwardly from the medial portion, and both the upper and lower arms terminate distally in ball-shaped ends. The upper and lower arms are disposed in a common hook plane. The rear surface of the medial portion includes a T-shaped slot dimensioned to encompass and engage the T-shaped cross-section of the web, the engagement removably retaining the hook on the web.

When the web baseline is disposed in a horizontal orientation, the hooks may be secured at each valley location of the web, so that the planes of the hooks are oriented vertically. If the web is disposed so that the baseline is oblique to horizontal, the hooks may be secured to the linear segments of the web, so that the hooks are supported with the hook planes in a vertical orientation.

The number and spacing of the hooks may be selected by the user during installation, in accordance with the intended use. The web may be oriented horizontally or obliquely, depending on the intended use, the space available for the assembly, and the esthetic appeal of the installation.

DESCRIPTION OF THE PREFERRED EMBODIMENT

Figures 1, 2, 3:
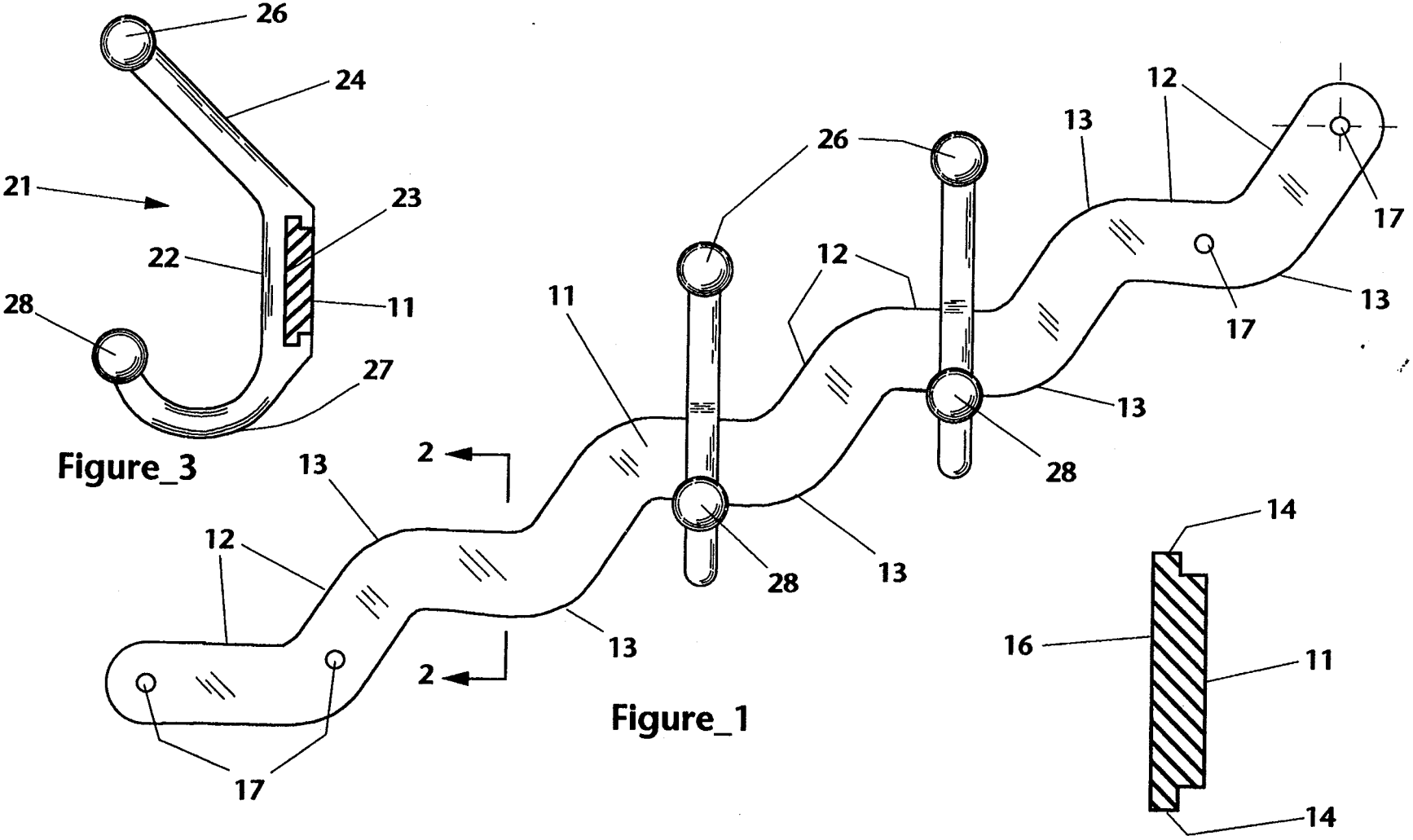
FIG. 1 is a plan view of the clothes hook assembly of the invention, shown in the oblique disposition.
FIG. 2 is a cross-sectional view of the web of the present invention, taken along line 2—2 of FIG. 1.
FIG. 3 is a side view of a hook member of the present invention.

The present invention generally comprises a clothes hook assembly that is adapted to be secured to a vertical support structure in a horizontal or oblique disposition. With reference to FIGS. 1 and 2, the assembly includes a hanger web 11 that is adapted to be secured to a vertical support such as a wall, door, post, or the like. The web 11 is provided with a serpentine configuration comprised of a plurality of linear segments 12 joined contiguously by smooth, curved conjunctions 13, with alternate linear segments extending in parallel relationship. In the preferred embodiment the web includes ten linear segments 12, although the number of linear segments is a matter of choice based on the desired overall length, and esthetics. As shown in FIG. 2, the web 11 is configured with a broad T-shaped cross-section, the T shape defined by a pair of flanges 14 extending from opposed top and bottom edges of the web and extending contiguously with the front surface 16 of the web. The web is also provided with two pair of mounting holes 17 adjacent to each end thereof. Fasteners such as screws, nails, or pins may be extended through the holes 17 into a vertical support structure, such as a wall, door, post, or the like.

The assembly also includes a plurality of hooks 21, as shown particularly in FIG. 3. Each hook 21 includes a medial portion 22 extending generally vertically and including a slot 23 extending into the rear surface thereof. The slot 23 is formed in a T-configuration, and dimensioned to engage the cross-sectional portion of the web 11 in a close tolerance fit. The rear surface of the medial portion 22 is substantially flush with the rear surface of the web 11, so that the web 11 may be secured to a vertical surface in flush relationship. The slot 23 is dimensioned so that the hooks may be slidably assembled to either end of the web 11 and translated therealong to a desired position. An upper arm 24 extends obliquely upwardly from the medial portion 22, and terminates in a ball end 26. A lower. U-shaped arm 27 depends from the medial portion 22, and terminates in a ball end 28. The arms 24 and 27 and the medial portion 22 are integrally formed and extend in a common plane, as is evident in FIGS. 1 and 4, which is generally vertical.

The web 11 may be secured to a vertical surface by screws, nails, or pins extending through the holes 17, in a disposition in which alternate linear segments 12 are extending horizontally and the major axis of the web (passing through the opposed ends) is inclined obliquely, as shown in FIG. 1. (Either end of the web may be the upper end.) Each of the hooks 21 may be secured to one of the horizontal linear segments 12, as shown, with the slot 23 engaging a cross-sectional portion of the web. This arrangement inherently orients the hooks 21 so that the hook planes are generally vertical.

Figure 4:
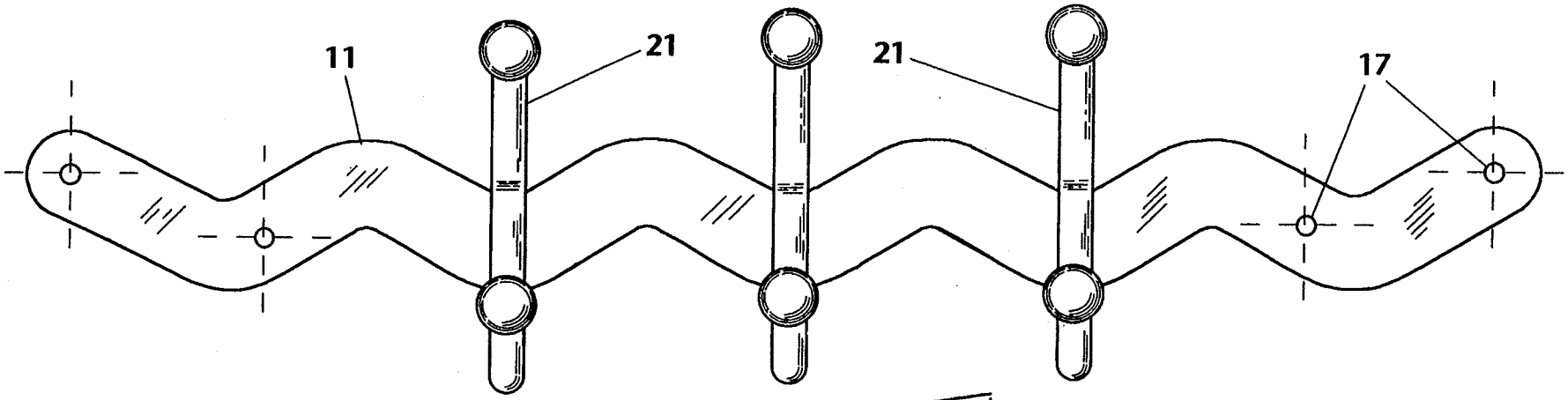
FIG. 4 is a plan view of the clothes hook assembly of the invention, shown in the horizontal disposition.
Figure 5:
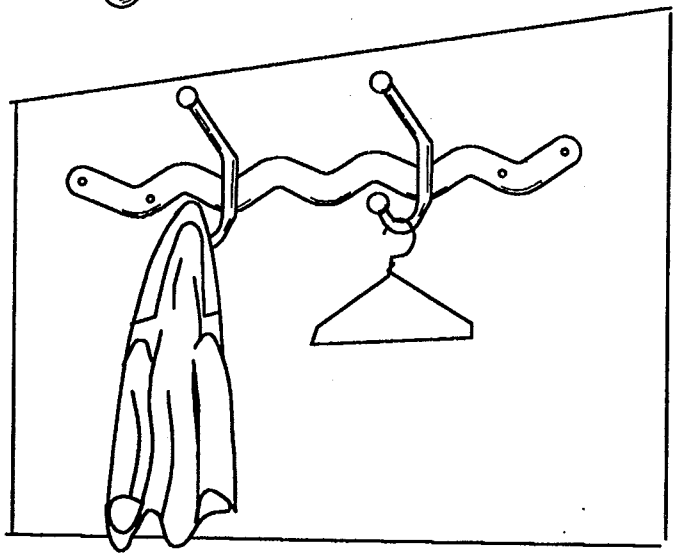
FIG. 5 is a perspective view of a typical installation of the clothes hook assembly.

Alternately, as shown in FIG. 4, the web 11 may be secured with the major axis in a horizontal disposition. In this case, the hooks 21 are secured to the web at the "valleys" defined by the smoothly contoured conjunctions 13, so that the hooks 21 are oriented are retained with the hook planes in a generally vertical disposition.

The web 11 may be sufficiently long to span the distance between two wall studs (generally 16 inches), whether in the horizontal or diagonal disposition, so that fasteners may be placed through the holes 17 into the studs. The choice of diagonal disposition permits the web to be used in narrow spaces where the horizontal web would be too long. The diagonal disposition permits some hooks 21 to be disposed above others, which is advantageous for growing children. Moreover, the vertically spread spacing permits a more interesting display of clothing on hangers for commercial purposes.

We claim:

1. A clothes hook assembly, including a web member extending longitudinally and having a longitudinal axis; a plurality of hooks, each having a nominal vertical plane; means for securing said web member to a vertical surface with said longitudinal axis defining any one of a plurality of angles with respect to horizontal; and means for securing said hooks to said web with said nominal vertical plane of each hook disposed vertically when said longitudinal axis of said web is disposed at any of said plurality of angles with respect to horizontal, said web including a plurality of segments arrayed serially, and said segments defining a serpentine arrangement extending along said longitudinal axis.

2. The clothes hook assembly of claim 1, wherein said segments are generally linear, and further including a plurality of curved conjunction sections, each joining confronting ends of adjacent linear segments.

3. The clothes hook assembly of claim 1, wherein said web member includes a T-shaped cross-sectional configuration.

4. The clothes hook assembly of claim 3, wherein said means for securing said hooks includes a a T-shaped slot in each hook dimensioned to releasably retain the cross-sectional configuration of said web member.

5. The clothes hook assembly of claim 4, wherein each of said hooks includes a medial portion, and said T-shaped slot is formed in said medial portion.

6. The clothes hook assembly of claim 5, further including an upper arm extending upwardly from said medial portion and a lower, U-shaped arm depending from said medial portion, said upper and lower arms and said medial portions disposed in said nominal vertical plane.

7. The clothes hook assembly of claim 1, wherein said means for securing said web member includes a plurality of holes extending through said web and adapted to receive fasteners therethrough.

8. The clothes hook assembly of claim 1, wherein said means for securing said hooks includes a plurality of slots, each in one of said hooks, each slot dimensioned to circumscribe a substantial portion of the cross-sectional configuration of said web member and releasably retain said web member.

* * * * *